US006393661B1

(12) United States Patent
Braid et al.

(10) Patent No.: US 6,393,661 B1
(45) Date of Patent: May 28, 2002

(54) SPRING MOUNTING ARRANGEMENT FOR A SASH WINDOW COUNTERBALANCE ARRANGEMENT

(75) Inventors: Harold Keith Braid, Braceborough; Simon Christopher Braid, Maxey, both of (GB)

(73) Assignee: Omega International Ltd., Peterborough (GB)

( * ) Notice: Subject to any disclaimer, the term of this patent is extended or adjusted under 35 U.S.C. 154(b) by 0 days.

(21) Appl. No.: 09/777,088

(22) Filed: Feb. 5, 2001

(51) Int. Cl.[7] ..... E05F 1/00

(52) U.S. Cl. ..... 16/197; 16/193; 16/DIG. 16; 49/445

(58) Field of Search ..... 16/197, 193, DIG. 16, 16/206, 205, 202, 400, 401; 49/176, 181, 445, 446, 447, 454, 456, 457

(56) References Cited

U.S. PATENT DOCUMENTS

| | | | | | |
|---|---|---|---|---|---|
| 2,644,193 | A | * | 7/1953 | Anderberg | 16/197 |
| 3,992,751 | A | * | 11/1976 | Foster et al. | 16/197 |
| 4,953,258 | A | * | 9/1990 | Mennuto | 16/193 |
| 4,961,247 | A | * | 10/1990 | Leitzel et al. | 16/193 |
| 5,157,808 | A | * | 10/1992 | Sterner, Jr. | 16/197 |
| 5,210,976 | A | * | 5/1993 | Cripps | 49/181 |
| 5,365,638 | A | | 11/1994 | Braid et al. | |
| 5,661,927 | A | * | 9/1997 | Polowinczak et al. | 49/446 |

FOREIGN PATENT DOCUMENTS

| | | |
|---|---|---|
| GB | 2278626 | 12/1994 |
| GB | 2295634 | 6/1996 |

* cited by examiner

*Primary Examiner*—Chuck Y. Mah
(74) *Attorney, Agent, or Firm*—Richard M. Goldberg

(57) ABSTRACT

A sash window counterbalance arrangement for counterbalancing the weight of a sash window includes a spring support mounting locating within a channel in a sash window jamb, a sash shoe slidable in the channel, a spring arrangement which generates a spring force between the mounting and sash shoe to counterbalance the weight of the window, the mounting including at least one mounting peg which projects from the mounting to engage a mounting aperture within one channel wall to locate and secure the mounting, with the mounting secured and located against slidable movement in a first direction due to the spring force, while movement of the mounting in an opposite direction causes disengagement of the mounting peg from the aperture and the mounting peg includes a lip flange which hooks over a portion of the channel wall adjacent the aperture to secure the mounting within the channel.

14 Claims, 4 Drawing Sheets

SPRING MOUNTING ARRANGEMENT FOR A SASH WINDOW COUNTERBALANCE ARRANGEMENT

BACKGROUND OF THE INVENTION

The present invention relates to sash windows and in particular to a mounting for the spring counterbalance arrangement used in such sash windows.

Modern sash window arrangements utilise flat coiled ribbon springs which are arranged to unwind as the sash window is slid and moved within a window frame. The coiled springs provide a counterbalancing force to counterbalance the weight of the sash window thereby making movement, and opening of the window easier. Typically the coiled springs are mounted, via a mounting arrangement, within a vertical channel section of the window frame or jamb. A free end, referred to as a tail, of the spring is connected to a sash shoe slidably mounted within the channel section of the window frame. The sash shoe in turn is connected to the sash window, usually towards the lower portion of the sash window.

The coil springs are generally of a constant tension type in which the outer profile of the coil itself is rotatably held and supported within the mounting, whilst an inner end of the spring is free such that the coil spring can rotate as the spring is unwound and the tail (outer end) is extended. To provide sufficient force to counterbalance the weight of the sash window multiple springs may be provided with the free ends or tails connected together.

An example of a prior arrangement, as generally described above, for mounting multiple springs for use in a sash window is described in U.S. Pat. No. 5,365,638 the contents of which are incorporated herein by reference.

As described in this prior patent, individual mounting means are provided for each of the coil springs. To provide a multiple spring assembly a number of individual mounting means are provided and stacked into an assembly within the window jamb. Other similar examples are disclosed in GB 2278626 and GB 2295634. A yet further arrangement is also described in our co-pending application GB 0027397.9 filed on Nov. 9, 2000, the text of which is incorporated in its entirety herein by reference.

In such prior systems the spring mounting assemblies are located within channels within the window frame or jamb. During assembly the spring mountings are inserted through an enlarged access portion of the channel, or inserted into the end of the channel, and are slid within the window jamb channel to the required position along the length of the channel. The mountings are then secured in position, along and within the channel, by means of a mounting screw, or number of mounting screws, which pass through the spring mounting and engage the window jamb. In this way the spring mounting, and so springs, are fixed and secured within the channel against movement within the channel.

Whilst this mounting arrangement, and similar prior arrangements, provide a practical method of mounting and supporting the springs, there are a number of problems with such an arrangement and the mounting arrangement can be improved generally.

In particular in a production environment the fitting of individual fixing screws to secure the support mounting within the channel is a relatively intricate and time consuming (and so costly) operation with the support having to be carefully aligned in position to allow the screws to be fitted. In addition the individual screws in themselves also increase the cost of the assembly. Furthermore in use and/or during assembly the sash shoe is sometimes inadvertently released from the sash window. This removal of load from the sash shoe can result in the sash shoe rapidly, and with some force, freely sliding within the channel under the tension of the counterbalance springs. The sash shoe will then contact and impact the fixed screw mounted spring support mounting with some considerable force and in some cases can fracture the support or shoe or strip the screws from the window frame. Such damage is clearly undesirable and indeed in some prior arrangements a rubber bump stop is provided to absorb the energy of any impact of the shoe with the spring support mounting. The cost of the rubber bump stop however is undesirable and also such systems do not entirely alleviate the problem.

SUMMARY OF THE INVENTION

It is therefore desirable to provide an improved sash window spring tensioning mounting arrangement which addresses some or all the above described problems and/or which offers improvements generally.

According to the present invention there is provided a sash window counterbalance spring mounting arrangement as described in the accompanying claims.

A sash window counterbalance arrangement for counterbalancing the weight of a sash window, in an embodiment of one aspect of the invention, comprises a sash window jamb with a channel defined within said sash window jamb. The channel has and is defined by a rear wall and a pair of side walls. The arrangement further comprises a sash window shoe slidable in said channel, spring means connected at one end to said sash shoe, and a spring mounting support fitted within said channel to support said spring means. In use a spring force is generated between said spring support and sash shoe to counterbalance the weight of said sash window. The spring mounting comprises at least one mounting peg which projects from said mounting to engage a mounting aperture defined within one of said channel walls to locate and secure said spring support mounting relative to said channel. Said mounting peg and aperture are arranged such that the spring support mounting is secured and located against slidable movement in use in a first direction due to the spring force, whilst movement of the mounting in an opposite direction causes disengagement of the mounting peg from the aperture.

Preferably a distal end of the mounting peg is profiled such that movement of said mounting in said opposite direction urges said mounting to disengage said mounting peg from said aperture. The distil end of the mounting peg may have a sloped profile. In particular a first portion of the distil end of the mounting peg projects further than a second portion of the mounting peg.

Furthermore a flange lip may project from a distil end of said mounting peg to define a hook means adapted to hook over a portion of the rear channel wall in the region of the aperture.

The mounting peg is preferably biassed into engagement with the aperture. Said biassing can be provided by resilient bending of the support and/or of the channel walls. Specifically said channel may further comprise front wall portions spaced a distance D from said rear wall. A front portion of said support abuts said front channel wall portions. The mounting pegs project from said support towards said rear wall such that the distance from said front portion of the support to the distil end of the mounting peg is greater than the distance D between said front and rear channel walls. In such an arrangement the support, and/or of the channel walls, are caused to deflect, or at least portions thereof, such that a resilient biassing force urging the mounting peg into the aperture is generated. The front portion of the support may comprise wing elements which project from a surface of said support, or a front surface of the support.

The support can be modular comprising a plurality of interengaged support elements. A plurality of mounting pegs may be used and provided.

A sash window counterbalance arrangement for counterbalancing the weight of a sash window, in an embodiment of another aspect of the invention comprises a sash window counterbalance arrangement for counterbalancing the weight of a sash window comprising a sash window jamb with a channel defined within said sash window jamb. The channel defined by and having a rear wall and a pair of side walls with at the extremities of said side walls inwardly directed front wall portions. A spring mounting support is fitted within said channel. The spring mounting comprises at least one mounting peg which projects from said mounting to engage a mounting aperture defined within one of said channel walls to locate and secure said spring support mounting relative to said channel. The mounting peg is resiliently biassed into engagement with said aperture.

A sash window counterbalance arrangement for counterbalancing the weight of a sash window, in an embodiment of further disclosed aspect comprises a sash window jamb with a channel defined within said sash window jamb and having a rear wall and a pair of side walls. A sash window shoe is slidable in said channel. A spring means is connected at one end to said sash shoe, and a spring mounting support fitted within said channel to support said spring means is arranged such that in use a spring force is generated between said spring support and sash shoe to counterbalance the weight of said sash window. The spring mounting comprises at least one mounting peg which projects from said mounting to engage a mounting aperture defined within one of said channel walls to locate and secure said spring support mounting relative to said channel. A distal end of said mounting peg includes a flange lip which projects from a distal end of said mounting peg to define a hook means adapted to hook over a portion of the rear channel wall in a region adjacent the periphery of the aperture defined in said rear channel wall.

BRIEF DESCRIPTION OF THE DRAWINGS

The present invention will now be described by way of example only with reference to the following figures in which.

DETAILED DESCRIPTION

Figure 1:
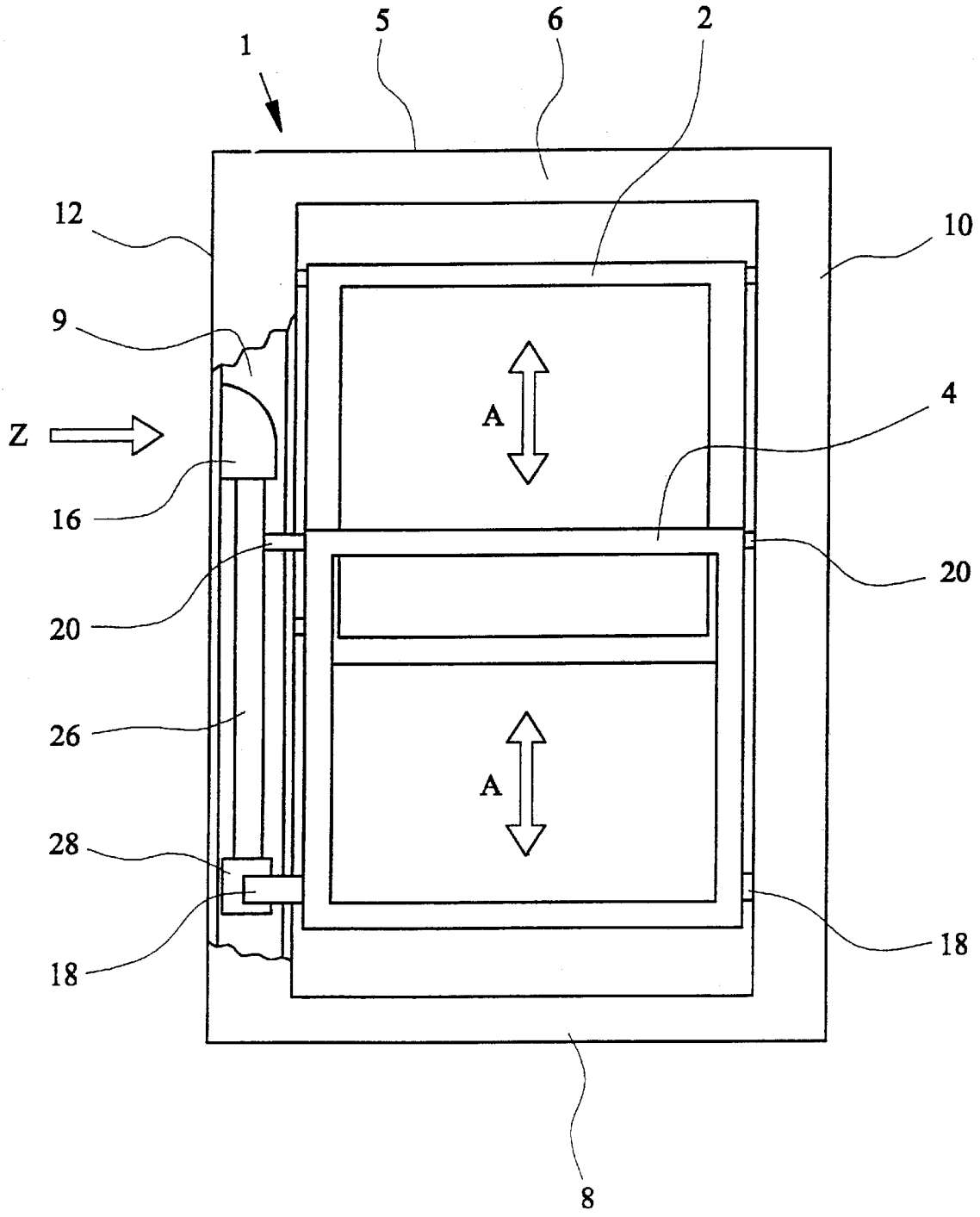
FIG. 1 is a schematic representation of a complete sash window assembly, with part of the window frame cut away to show the counterbalance spring mounting arrangement in accordance with the present invention.

Referring to FIG. 1, a sash window 1 comprises upper 2 and lower 4 sashes which are slidably mounted within a window frame 5 such that each sash 2,4 can be slid vertically, as indicated by arrow A, to open the window. The sashes 2,4 are disposed generally vertically and are disposed closely adjacent to each other with one sash 2 sliding behind the other 4. The window frame 5 comprises upper 6 and lower 8 horizontal frame members and two vertical laterally spaced window jamb members 10,12. The window jambs 10,12 have a double vertically extending channel section. Each channel section 9 of the double channel section is disposed side by side within the window jamb 10,12 adjacent and along the lateral side of a respective sash window 2,4 with an open part of the channel section 9 facing the sash window 2,4 and extending along the length of the window jamb 10,12. The cutaway portion of FIG. 1 shows a part of one of the channel sections 9 and the internally mounted components therein of the lower sash window 4.

Pivot. pins 18, located towards the lower part of the sash window 2,4, extend and project laterally from the lower sides of the sash window 2,4. Tilt latches 20, located towards the upper part of the sash window 2,4, similarly project laterally from the sides of the sash window 2,4. The distal ends of the tilt latches 20 and pivot pins 18 are engaged within the open part of the window jamb channels 9. The sash windows 2,4 are thereby slidably located within and with respect to the window frame 5 by the engagement of the pivot pins 18 and tilt latches 20 within the channels 9 in the window jambs 10,12. The tilt latches 20 are also laterally retractable from engagement within the channel 9 such that the upper portion of the sash window 2,4 can be disengaged allowing the sash window 2,4 to be tilted and pivoted about the pivot pins 18 to provide easy access to the window pane, in particular for cleaning.

Spring counterbalance mechanisms 16, to counterbalance the weight of the sash window 2,4, and make vertical sliding of the sash windows 2,4 easier, are mounted and located within the channel sections 9 of the window jambs 10,12 on each lateral side of the sash window 2,4 with a pair of such mechanisms 16 provided for each window 2,4. In FIG. 1 only one such mechanism 16 for one side of the sash window 4, is shown in the interest of clarity and brevity.

Figure 2:
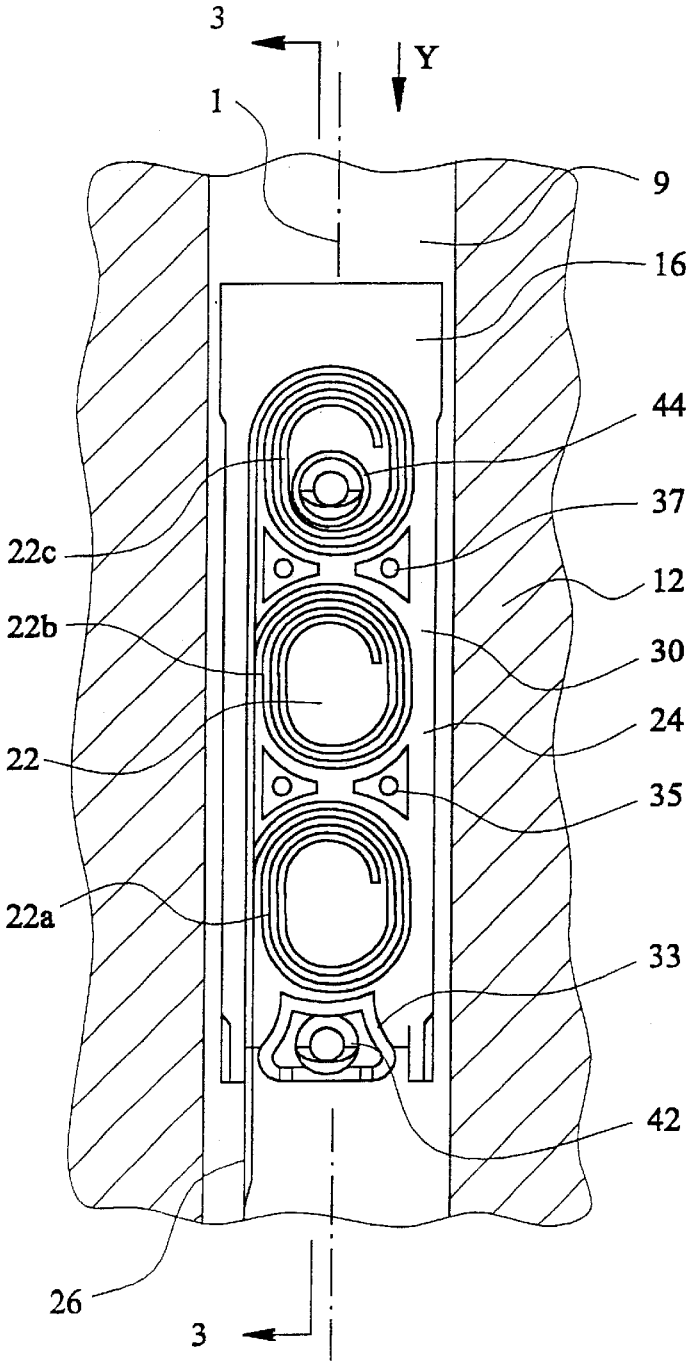
FIG. 2 a schematic more detailed sectional view view through the window jamb channel of, one of the spring support mountings of FIG. 1.

The spring counterbalance mechanism 16 comprises a spring arrangement 22, typically one or more coil springs 22*a*,22*b*,22*c*, which are located and supported by and within a spring support mounting 24. The spring support mounting 24 is located within the channel section 9 within the window jamb 12 and is fixed and secured in position to the window jamb 12. The outer free ends of the springs 22*a*,22*b*,22*c* are connected together to form a common tail 26 which extends, and is drawn out from the spring support, and is connected to the sash shoe 28. The end portion or tail 26 of the spring arrangement 22 is connected to a sliding shoe 28 also located within the channel 9 and to which the pivot pins 18 are engaged. In operation as the sash window 2,4 slides vertically within the window frame 5 the sash shoe 28 slides vertically within the channel 9 and draws out the spring tail 26 from the spring support 24. Accordingly the spring arrangement 22 provides a vertical tension force as it is drawn out from the fixed spring support mounting 24. This provides a vertical counterbalance force to counteract and offset the weight of the sash window 2,4. The spring support mounting 24 and spring arrangement 22 are shown in more detail in FIG. 2.

The spring support mounting 24 comprises a plate like generally rectangular main body portion 25 with a front surface 21 which when installed in the jamb 12 faces outwards from the window jamb 12 channel section 9, and a rear surface 23 which faces towards and into the jamb channel section 9. Integral with the main body portion 25 and extending from the rear surface 23 thereof are spring support projections 33,35,37 disposed at spaced positions along the length of the main body portion 25 of the spring support mounting 24.

The spring arrangement 22 comprises three flat ribbon coiled springs, lower 22*a*, middle 22*b* and upper 22*c* (as considered in their final installed positions shown in FIG. 2), located within and on the spring support mounting 24. The outer coiled body portions of the three flat coiled ribbon springs 22*a*,22*b*,22*c* are supported by and on the respective spring support projections 37,35,33 of the spring support mounting 24. An axial end of the coil springs 22*a*,22*b*,22*c* abuts against the rear surface 23 of the main body portion 25 of the support mounting 24.

The inner free ends of the flat ribbon coil springs 22*a*, 22*b*,22*c*, in the centre of the coil springs, are generally free such that as the springs 22*a*,22*b*,22*c* unwind they rotate within the spring support mounting 24 and the springs 22 provide a generally constant force as there are, in use, unwound and the tail 26 is drawn out from the spring support 24.

The channel section 9, within which the spring support mounting 24 is installed is defined by a rear wall 11 facing outwardly towards the sash 2,4 and two side walls 11*a*,11*b* which extend from the rear wall 11. Short front wall portions 13, or flanges, generally parallel to the rear wall 11 extend oppositely inwardly from the ends of the side walls 11*a*,11*b* towards each other to partially close off and define the channel 9 (sometimes termed a jamb pocket) with an opening 40 of the channel 9 of a smaller dimension adjacent to the sash 2,4. Along a small section (typically 50 mm) of the channel section 9 however the front wall members 13 are removed, or reduced in extent, to provide an enlarged access opening (not shown) into the channel section 9. Such an opening in the channel section 9 is an industry standard and is to allow a spring counterbalance mechanism 16 and component parts to be inserted into, and removed from, the channel section 9.

Mounting pegs 42,44, which as shown are generally cylindrical, project and extend from the main body portion 25 of the support mounting 24 and rear surface 23 thereof. It will be appreciated though that the mounting pegs could have an oval, rectangular, square, hexagonal or other shaped cross section. In this embodiment a pair of mounting pegs 42,44 are disposed towards the upper and lower part of the support 24 respectively. The distal ends of the mounting pegs 42,44 have a sloped profile 46 such that a lower portion 48 of the mounting peg 42,44 extends further from the support mounting than an upper portion (as shown in the figures).

It will be appreciated that whilst in this particular embodiment a pair of mounting pegs 42,44 are used, the number of mounting pegs 42,44 may be varied depending upon the particular requirements of a particular spring support mounting and in particular the loading on the spring support 24. For example a single mounting peg may be used and positioned towards the lower end of the mounting (as in the embodiment shown in FIG. 6 and 7), or an additional mounting peg could be provided part way along the spring support mounting 24.

Figure 3:
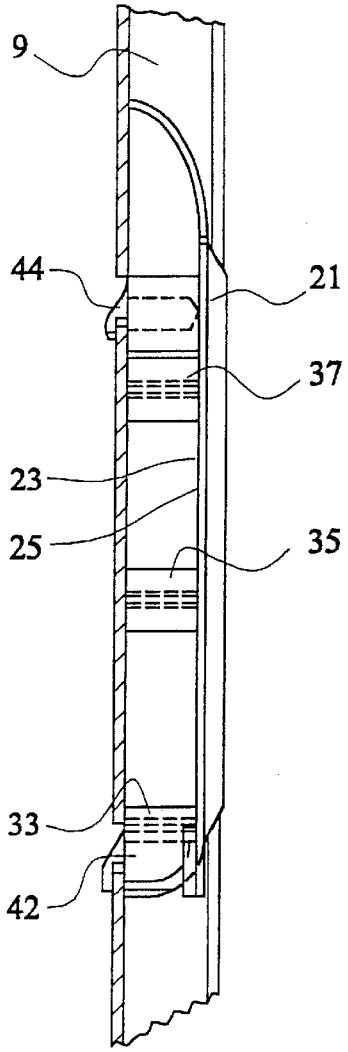
FIG. 3 a schematic sectional view on line 3—3, shown in FIG. 2 of the spring support mounting with the springs omitted for clarity.
Figure 4:
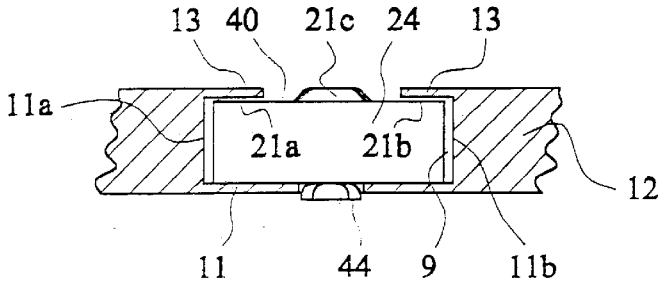
FIG. 4 is an end view on arrow Y shown in FIG. 2 of the spring support mounting located within the channel.
Figure 5B:
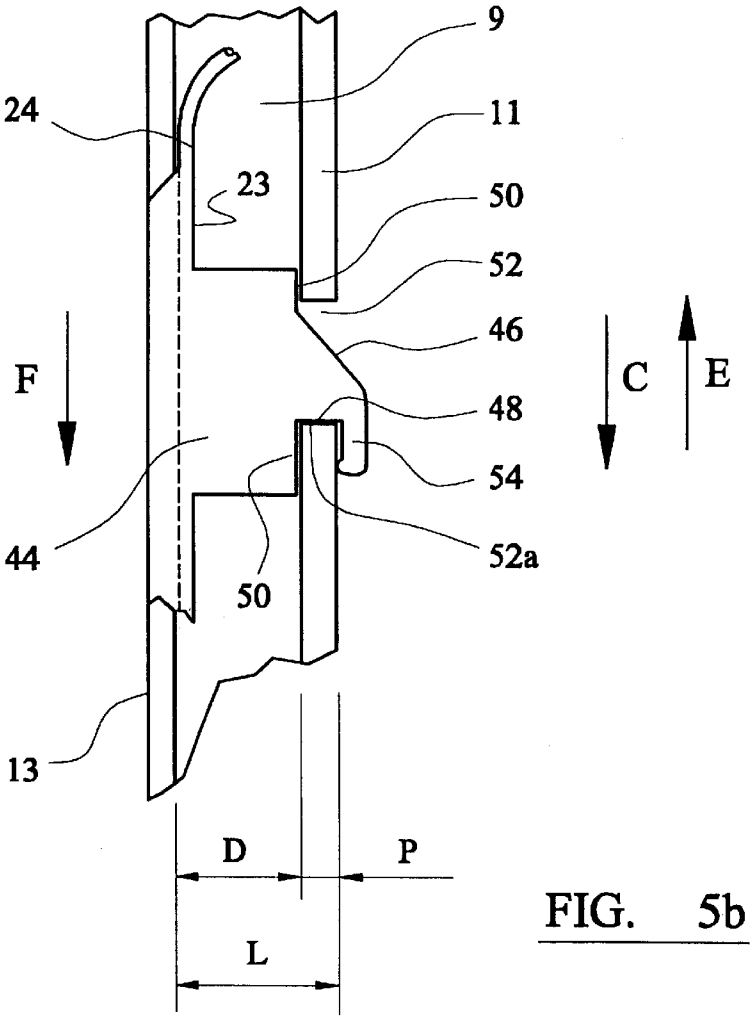
FIGS. 5*a* and 5*b* are more detailed views of a mounting peg of the spring support mounting illustrating the mounting peg of the spring support mounting into the window jamb in accordance with the present invention.

When the spring support 24 is mounted within the channel 9, as shown in FIGS. 3 and 5*b*, shoulder portions 50 of the mounting pegs 42,44 abut against the rear wall 11 of the channel 9. The lower portion 48 of the mounting peg 42,44 extends into and is engaged within a respective corresponding predrilled mounting hole 52 within the rear wall 11 of the channel 9. Specifically the lower portion 48 of the mounting peg 42,44 engages and abuts against the lower section 52*a* of the predrilled hole 52 in the rear channel wall 11. Edge portions 21*a*,21*b* of the front surface 21 of the main body 25 of the spring support 24 abut against the front walls 13 of the channel 9. As a result and due to the resilience of the spring support 24 and/or of the channel walls, which are preferably fabricated from a resilient plastics material, the distal end of the mounting peg 42,44 is urged into the predrilled hole 52 and is maintained in engagement therein. In effect the dimensions of the spring support mounting 24, the projection of the mounting peg 42,44, and resilience of the spring support 24 and the arrangement as a whole, are arranged to provide a bias force to urge the distal end of the mounting peg 42 in the mounting hole 52. The mounting hole 52 is positioned at a corresponding position for mounting the support 24 at the desired position along and within the channel 9.

In addition a lip flange 54 extending perpendicularly to the mounting peg 42,44 and from the lower portion 48 of the mounting peg 42,44 defines a hook means with a slot recess 56 defined between the lip flange 54 and shoulder portion 50 of the mounting peg 42,44. When installed the lip flange 54 is hooked over the rear channel wall 11 with the slot 56 engaging with a portion of the rear wall 11 around and adjacent the lower part and peripheral region of the hole 52. The engagement of the mounting peg 44,42 is shown more clearly in FIG. 5*b* which shows a mounting peg 42,44 in the installed position.

In this way the spring support 24 is securely located and fixed in position along the channel section 9 of the window jamb 10,12 by the mounting pegs and their engagement with the predrilled mounting holes 52 in the rear wall 11. The lip flange 54 and engagement of the channel wall 9 and slot 56 provides further security in the mounting and engagement of the mounting peg 42,44. Furthermore in operation the load on the support mounting 24 generated by the spring arrangement 22 urges the spring support 24 downwards. This further urges the hook means into engagement with the lower sector 52*a* of the predrilled hole 52 and rear wall 11.

The spring support 24 is installed within the channel 9 through the enlarged access opening in the channel 9. Alternatively the support 24 may be inserted through the end of the channel 9. The support mounting 24 is then slid within the channel 9 to the required position adjacent to the predrilled mounting hole 52 provided at a location along the channel 9 where the support 24 is to be located. The support is preferably slid along the channel 9 in an upwards direction into position and the sloped profile 46 of the mounting peg 42,44 permits easy sliding of the support in this upwards direction. As the support mounting 24 is slid within the channel 9 the distal end of the mounting pegs 42,44 abuts against the rear wall 11 of the channel 9. The distal end of the mounting pegs 42,44 projects P further than the depth D of the channel section 9. The distance L from the abutting front portion 21*a*,21*b* of the support to the distal end of the mounting peg 42,44 being greater than the channel depth D.

Figure 5A:
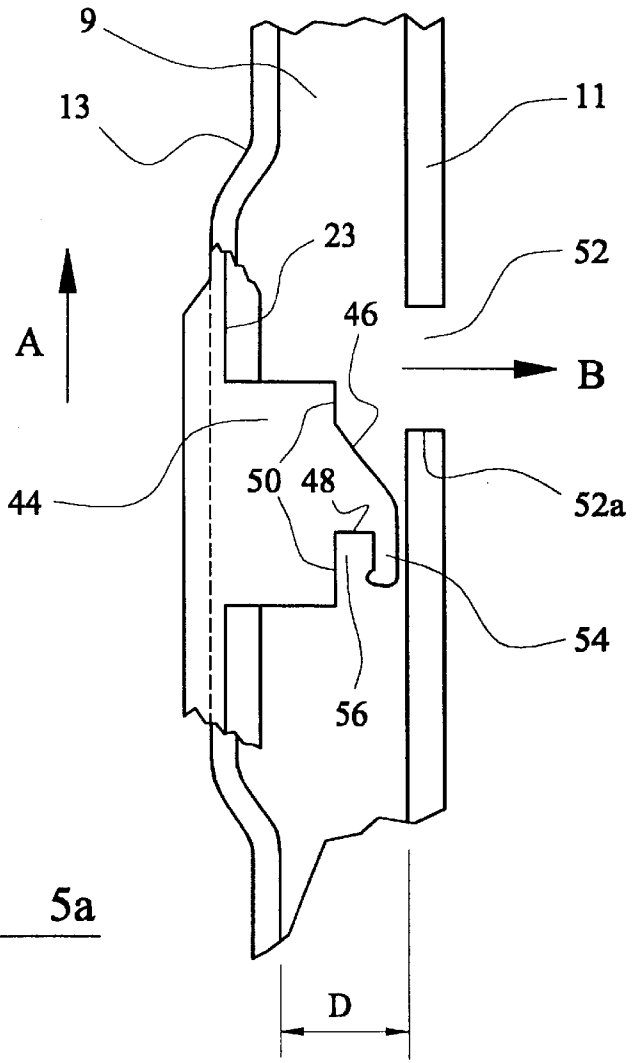

Consequently the support 24, and/or the channel walls, bow and bend about a longitudinal axis 1, with the centre portion 21*c* of the front surface 21 of the support bowing out through the channel opening 40 in order to be fitted within the channel 9 at positions where the mounting pegs 42,44 are,not engaged within the mounting holes 52 and where the distal end of the mounting pegs 42,44 abut against the rear wall 11. This can be seen in FIG. 5*a* which shows the situation prior to engagement of the mounting pegs 42,44 within the holes 52. As illustrated the centre section of the support bows out through the channel opening 40. In addition the front channel walls 13 are bowed outwards slightly in the region of the support to accommodate the support mounting 24. It will be recognised that the other channel walls, in particular rear wall 11, could, depending upon their resilience and stiffness/rigidity, also bow and bend to accommodate the support mounting 24.

Once the support 24 is in position adjacent to the mounting holes 52, and the distal end of the mounting pegs 42,44 encounter the predrilled holes 52, the distal end of the pegs 42,44 are urged, by the resilience of the support 24 and its bowing, into the holes 52 and into engagement within the holes 52. Once the mounting pegs 42,44 enter the mounting holes 52, the support is moved downwards such that the lip flange 54 hooks over the lower sector 52*a* of the mounting hole 52 and rear wall 11 and the lower part of the mounting pegs 42,44 abuts against the lower sector of the mounting hole 52*a*. This downwards movement secures and ensures engagement of the mounting peg 42,44 within the mounting holes 52. The movement of the mounting peg 42,44 and support 24 during installation is indicated by arrows A, B, and F in FIGS. 5*a* and 5*b*. The bowing of the support within the channel 9 biases the mounting pegs 42,44 towards the rear wall 11. Consequently the support 24 is self locating and self fixing within the channel as it is slid into the correct position.

To remove the support 24, the support 24 is slid upwards within the channel 9. The sloped profile 46 of the distal end of the mounting peg 42,44 and set back arrangement of the upper portion of the distal end of the mounting peg 42,44 allows and causes the distal end of the mounting peg 42,44 to be disengaged from the hole 52. The sloped profile of the distal end of the mounting peg 42,44 abutting against an upper edge portion of the mounting aperture 52 with the distal end of the mounting peg 42,44 thereby sliding over the edge and being urged out of engagement with the mounting aperture 52. This disengages the fixing of the support 24 to the rear wall 11 of the channel 9. The support 24 can then be slid further upwards and removed from the channel 9 through the access opening.

It will be appreciated that such upwards movement of the support 24 in normal operation is against and resisted by the spring tension provided by the spring arrangement 22 and resultant downwards loading on the support 24. Downwards movement of the spring support 24 is prevented by the engagement of the lower portion 48 of the mounting peg 42,44 with the hole 52 in rear wall 11. In effect the profiling and arrangement of the mounting pegs 42,44 shown provides in this embodiment a unidirectional locating and securing of the support 24. This means that movement of the support 24 in a first direction (downwards), indicated by arrow C, is resisted by the mounting arrangement whilst movement in the opposite direction (upwards), indicated by arrow E causes disengagement and is permitted.

In the event of inadvertent release of the sash shoe 28 from the sash window 2,4, or removal of the load from the sash shoe 28, the sash shoe 28 will rapidly move upwards with some force under the influence of the spring tension and spring arrangement 22. In such a case the sash shoe 28 may impact the bottom lower end of the spring support 24 with considerable force. Rapid upward movement of the sash window 2,4, and so of the sash shoe 28, by an operator opening the window may also cause the sash shoe 2,4 to impact the bottom of the spring support mounting 24. In these cases with prior arrangements damage can be caused to the spring mounting. However with the mounting arrangement of the invention described above, the support mounting 24 can, in a similar manner as with removal of the spring mounting 24, move upwards following such impact and will automatically become disengaged with the impact energy being gradually absorbed. As a result, and since the support 24 can move following the impact any potential damage is reduced.

In this particular embodiment shown and described the front surface 21 of the support 24 abuts against the front wall 13 of the channel and bowing of the entire support mounting 24, and/or the channel walls, provides a resilient biassing force to urge the mounting peg 42,44 into the mounting hole 52. In alternative embodiments however such biassing of the support 24 may not be required and/or even desired in order to make installation easier. In such cases the support 24 and mounting peg 44 projecting from the support 24 would be arranged and dimensioned to be accommodated within the channel section 9 without requiring bending of the support and/or of the channel walls. When the support is installed the front surface 21 of the support 24 would not abut against the front channel walls 13. The hooking of the lip flange 54 over the rear channel wall 11 then becomes a more significant feature when there is no biased load, with the hooking of the lip flange providing the main means to secure the mounting peg 44 in engagement with, and within, the mounting hole 52.

Figure 6:
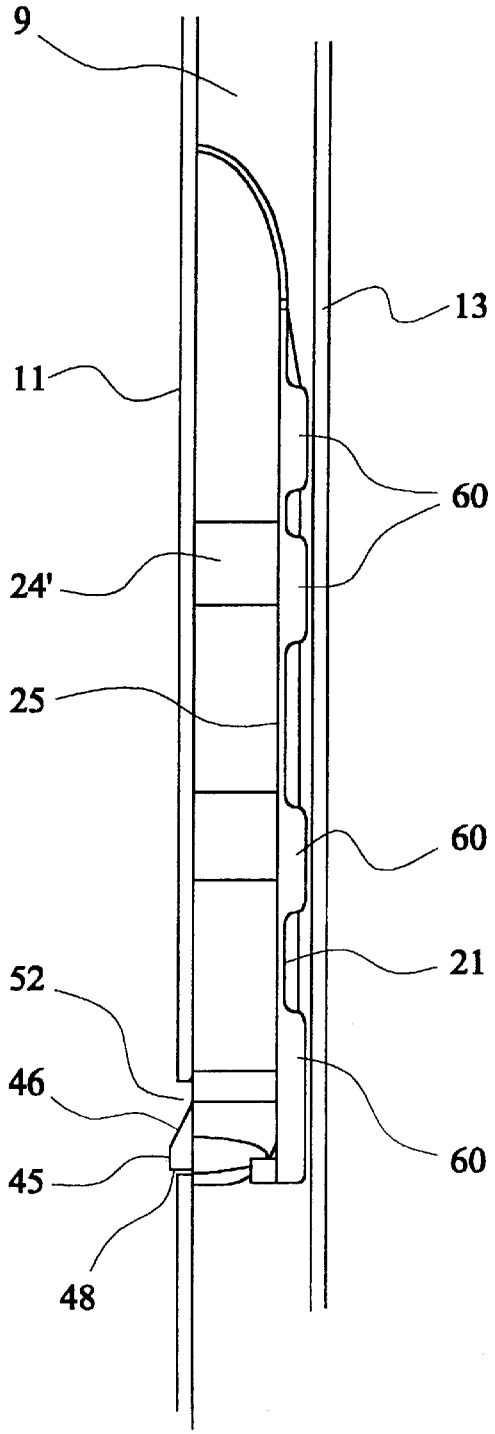
FIG. 6 is a schematic sectional view similar to FIG. 3, but of an alternative embodiment of the invention.
Figure 7:
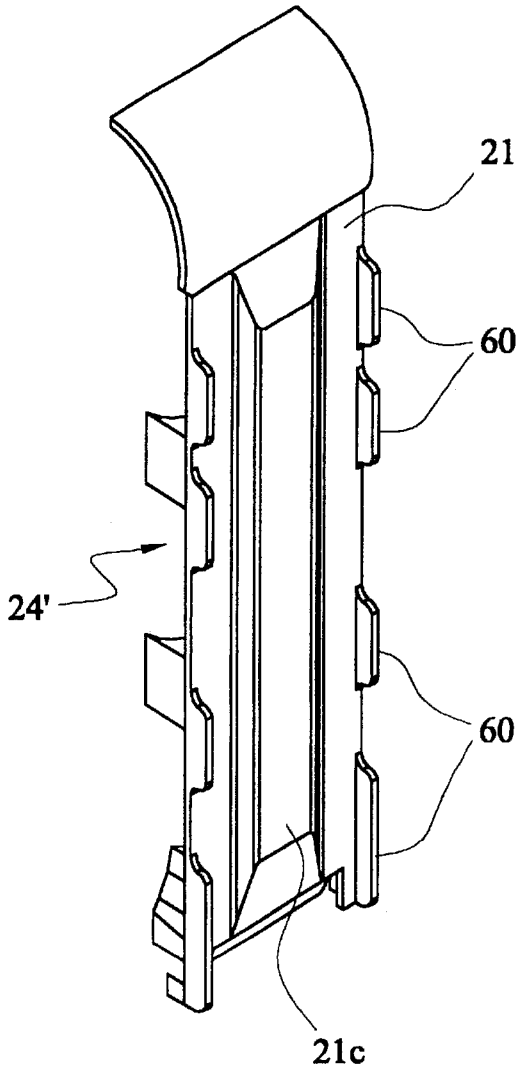
FIG. 7 is a perspective view of the spring support mounting shown in FIG. 6.

FIGS. 6 and 7 show a further alternative embodiment of the invention. This embodiment is generally similar to that shown in the previous figures and like reference numerals have been used for like features, with only the main differences now being described.

The spring support mounting 24' of this embodiment includes only a single mounting peg 45 which is disposed towards the lower end of the spring support mounting 24'. This mounting peg 45 also does not include a lip flange and, as shown the mounting peg 45 simply engages within the mounting hole 52 within the rear wall of the channel 9.

Since the mounting peg 45 does not include a lip flange, the biassing of the support 24' when fitted within the channel 9, as described in the first embodiment, is more significant in the arrangement of FIGS. 6 and 7 in order to ensure that the mounting peg 45 remains in engagement with mounting hole 52. In this embodiment wing projections 60, projecting from the front surface 21, are provided along the sides of the main body of 25 the support mounting 24. The distal ledges of these wing projections abut, when the support is installed within the channel 9, against the front walls 13 of the channel 9. The wing projections space the front surface 21 of the support mounting 24 from the front walls 13 of the channel 9. Bending of the wing projections, in addition or instead of bending or bowing of the support and/or of the channel walls, provides a resilient bias force to urge the distal end of the mounting peg 45 into the mounting hole 52 and maintain engagement of the mounting peg 45 within the mounting hole 52. It will be appreciated that such wing projections can be made more flexible than the remainder of the support mounting 25 and or the channel walls. Such wing projections as used in a spring support in general are shown and described in our co-pending application GB 0027397.9 filed on Nov. 9, 2000, the contents of which are hereby incorporated herein by reference.

It will be recognized that whilst wing projections 60 are illustrated in the arrangement of FIG. 6, and in some cases are preferred in other embodiments the bending and bowing of the support 24 and/or channel walls 11,13 may provide sufficient deflection to accommodate the spring support 24 and provide the required degree of resilience. Consequently an arrangement of FIG. 6, but without wing projections and with the front surface 21 abutting the front channel walls 13 is envisaged.

Modular spring mounting arrangements are also known comprising a series of spring support elements which are stacked on top of each other with each element supporting an individual spring. Such an arrangement is shown in U.S. Pat. No. 5,365,638. The mounting peg, or spigot, arrangement of the present invention described above can be applied to secure such similar arrangements within the channel of a window jamb and in place of the screw type fitting conventionally used in such arrangements. Mounting pegs can be provided for each spring support element. Alternatively mounting pegs can be provided for only some of the elements making up the modular spring support with the other elements being located and secured by their interengagement with those elements incorporating a mounting peg. Indeed a mounting peg can be provided on only the lowermost spring support element with the remaining. element of the modular spring support stacked on top of the lowermost element and being supported by and on the lowermost element.

In a yet further variation the mounting peg could be retractable, the mounting peg being retracted to allow the support to be slid into position within and along the channel with the mounting peg extending to project into the mounting hole when in the position adjacent to the mounting hole. Such a retractable mounting peg is biassed towards an extended projecting position such that engagement with the mounting hole is automatic once the support is slid into position.

Many other variations of the invention will also be apparent to those skilled in the art and various combinations, and use of individual features of the various features of the different embodiments are contemplated.

What is claimed is:

1. A sash window counterbalance arrangement for counterbalancing the weight of a sash windows, comprising:

a sash window jamb with a channel defined within said sash window jamb and having a rear wall and a pair of side walls, a sash window shoe slidable in said channel, a spring arrangement connected at one end to said sash shoe, and a spring support mounting fitted within said channel to support said spring arrangement such that in use a spring force is generated between said spring support mounting and sash shoe to counterbalance the weight of said sash window, the spring support mounting comprising at least one mounting peg which projects from said spring support mounting to engage a mounting aperture defined within one of said channel walls to locate and secure said spring support mounting relative to said channel, wherein said at least one mounting peg and aperture are arranged such that the spring support mounting is secured and located against slidable movement, in use, in a first direction due to the spring force, while movement of the spring support mounting in an opposite direction causes disengagement of the at least one mounting peg from the aperture.

2. A sash window counterbalance arrangement as claimed in claim 1 in which a distal end of the at least one mounting peg is profile such that movement of said spring support mounting in said opposite direction urges said spring support mounting to disengage said at least one mounting peg from said aperture.

3. A sash window counterbalance arrangement as claimed in claim 2 in which the distal end of the at least one mounting peg has a sloped profile.

4. A sash window counterbalance arrangement as claimed in claim 1 in which a first portion of a distal end of the at least one mounting peg projects further than a second portion of the at least one mounting peg.

5. A sash window counterbalance arrangement as claimed in claim 1 in which a flange lip projects from a distal end of said at least one mounting peg to define a hook adapted to hook over a portion of the rear channel wall in a region adjacent a periphery of the aperture defined in said channel wall.

6. A sash window counterbalance arrangement as claimed in claim 1 in which the at least one mounting peg is biassed into engagement with the aperture.

7. A sash window counterbalance arrangement as claimed in claim 6 in which said biassing is provided by resilient bending of the spring support mounting.

8. A sash window counterbalance arrangement as claimed in claim 1 in which:

said channel further comprises a front wall spaced a distance D from said rear wall, a front portion of said spring support mounting abuts said front channel wall, said at least one mounting peg projecting from said spring support mounting towards said rear wall, herein the distance from said front portion of the spring support mounting to a distal end of the at least one mounting peg is greater than the distance D between said front and rear channel walls.

9. A sash window counterbalance arrangement as claimed in claim 8 in which said front portion comprises wing elements which project from a surface of said spring support mounting.

10. A sash window counterbalance arrangement as claimed in claim 1 in which said support mounting is modular comprising a plurality of interengaged stacked spring support elements.

11. A sash window counterbalance arrangement as claimed in claim 1 comprising a plurality of mounting pegs.

12. A sash window counterbalance arrangement as claimed in claim 6 in which said biassing is provided by resilient bending of the channel wall.

13. A sash window counterbalance arrangement for counterbalancing the weight of a sash window, comprising:

a sash window jamb with a channel defined within said sash window jamb and by a rear wall, a pair of side walls and at extremities of said side walls inwardly directed front wall portions, and a spring support mounting fitted within said channel, the spring support mounting comprising at least one mounting peg which projects from said spring support mounting to engage a mounting aperture defined within one of said channel walls to locate and secure said spring support mounting relative to said channel, wherein said at least one mounting peg is resiliently biassed into engagement with said aperture.

14. A sash window counterbalance arrangement for counterbalancing the weight of a sash window, comprising:

a sash window jamb with a channel defined within said sash window jamb and having a rear wall and a pair of side walls, a sash window shoe slidable in said channel, a spring arrangement connected at one end to said sash shoe, and a spring support mounting fitted within said channel to support said spring arrangement such that in use a spring force is generated between said spring support mounting and sash shoe to counterbalance the weight of said sash window, the spring support mounting comprising at least one mounting peg which projects from said spring support mounting to engage a mounting aperture defined within one of said channel walls to locate and secure said spring support mounting relative to said channel, wherein a distal end of said at least one mounting peg includes a flange lip which projects from the distal end of said at least one mounting peg to define a hook adapted to hook over a portion of the rear channel wall in a region adjacent a periphery of the aperture defined in said rear channel wall.

* * * * *